US006997115B2

(12) United States Patent
Lockwood et al.

(10) Patent No.: US 6,997,115 B2
(45) Date of Patent: Feb. 14, 2006

(54) STEADY TABLE

(76) Inventors: Joshua C. Lockwood, 14025 Leahy Ave., Bellflower, CA (US) 90706; Tramale Chatman, 15544 ½ Leahy Ave., Bellflower, CA (US) 90706

( * ) Notice: Subject to any disclaimer, the term of this patent is extended or adjusted under 35 U.S.C. 154(b) by 179 days.

(21) Appl. No.: 10/665,913

(22) Filed: Sep. 19, 2003

(65) Prior Publication Data

US 2005/0061212 A1 Mar. 24, 2005

(51) Int. Cl.
*A47B 3/00* (2006.01)

(52) U.S. Cl. ..... 108/115

(58) Field of Classification Search ..... 108/115, 108/128, 119, 162, 166, 177, 193, 169, 170, 108/173, 174; 312/195, 196
See application file for complete search history.

(56) References Cited

U.S. PATENT DOCUMENTS

| | | | | |
|---|---|---|---|---|
| 2,890,089 | A | 6/1959 | Sanchez | |
| 3,322,077 | A * | 5/1967 | Kovacik | 108/115 |
| 3,455,255 | A | 7/1969 | Sanchez | |
| 3,527,174 | A * | 9/1970 | Lay | 108/115 |
| 3,722,702 | A * | 3/1973 | Marker, Jr. | 108/115 |
| 5,337,657 | A * | 8/1994 | Diffrient | 108/115 |
| 5,904,104 | A * | 5/1999 | Yu | 108/116 |
| 6,082,838 | A * | 7/2000 | Bissu-Palombo | 312/195 |
| 6,289,824 | B1 * | 9/2001 | Parker et al. | 108/115 |
| 6,314,892 | B1 * | 11/2001 | Favini | 108/115 |
| 6,698,364 | B1 * | 3/2004 | Welch et al. | 108/115 |
| 6,752,090 | B1 * | 6/2004 | Schenker et al. | 108/115 |
| 6,786,162 | B1 * | 9/2004 | Volkmer et al. | 108/115 |
| 6,817,302 | B1 * | 11/2004 | Norstad | 108/115 |

* cited by examiner

*Primary Examiner*—Jose V. Chen
(74) *Attorney, Agent, or Firm*—Curtis L. Harrington

(57) ABSTRACT

A compact, hinged, foldably deployable table utilizes a main square or rectangular member which pivotally supports a pair opposing side members from a position flatly adjacent the main member to a position at a right angle from the main member. An overlying top frame section folds from a position parallel to the main member and adjacent the side members, to a position at a right angle with respect to the main member. Locking members in the top frame positively engage and stabilize the side members. An overlying top which fits exactly within the upper frame is carried by the frame and provides sturdy support.

5 Claims, 8 Drawing Sheets

STEADY TABLE

FIELD OF THE INVENTION

The present invention relates to an improvement in providing a stable, efficient load bearing deployable table which is especially useful for quick setups and break down, and more particularly to a foldable table with advantageously located locking mechanisms.

BACKGROUND OF THE INVENTION

Foldably deployable and stowable tables are known in the art which give some flexibility to the user in terms of providing a somewhat stable structure in the deployed position and which provide some reduction in space for storage. From card tables to folding leg tables, all compromise significantly in structure to achieve stowability.

In cases where expensive or delicate equipment is involved, there is an acute need for extremely sturdy raised working surfaces which have the capability for securely holding significant weight. The weight of the tables is always an issue, and the support structures used for the equipment should not overly burden the total weight of transport of the support and equipment to be supported.

Where support structures have the ability to be stowed and deployed, a number of considerations must be addressed including the lockability in the stowed position so that the table support may be manually transported without injury, as well as the deployed position locking stability. Lack of stowed stability can result in injury, whereas the lack of deployed position locking stability can result in both damage to equipment and more severe injury.

Further, where equipment has to be transported and set up on areas which may be cramped or uneven, the ability to provide rough leveling is similarly important. The ability of a support platform to provide leveling should not be accomplished with the addition of excessive weight or complexity. All of the needed attributes should be available without having to resort to space occupying support members which eliminate the ability to utilize the space beneath the table support.

SUMMARY OF THE INVENTION

A compact, hinged, foldably deployable table utilizes a main square or rectangular member which pivotally supports a pair opposing side members. The side members pivot from a position flatly adjacent the main member to a position at a right angle from the main member. An overlying top frame section folds from a position parallel to the main member and adjacent the side members, to a position at a right angle with respect to the main member. Locking members in the top frame positively engage the side members. An overlying top which fits exactly within the upper frame may be carried separately from the top frame or attached to it, and provides a sturdy support. The structural members are preferably made from strong materials, for example eighteen gauge steel or better; chrome molybedenum, aluminum and the like, just to name two examples. The main support elements of each of the main, side and top frame sections is formed of a square tubular shape, typically 0.625 inches square, externally. A series of from two to four telescoping leg extensions may be each employed within the two vertical members of the main support and within one of the vertical members of the side supports farthest from hinged connection to the main support. A series of button detents in the are preferably used to set the telescoping extension distance of the telescoping leg extensions from the vertical members in which they reside, to enable a quantitative leveling of the resulting support structure.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
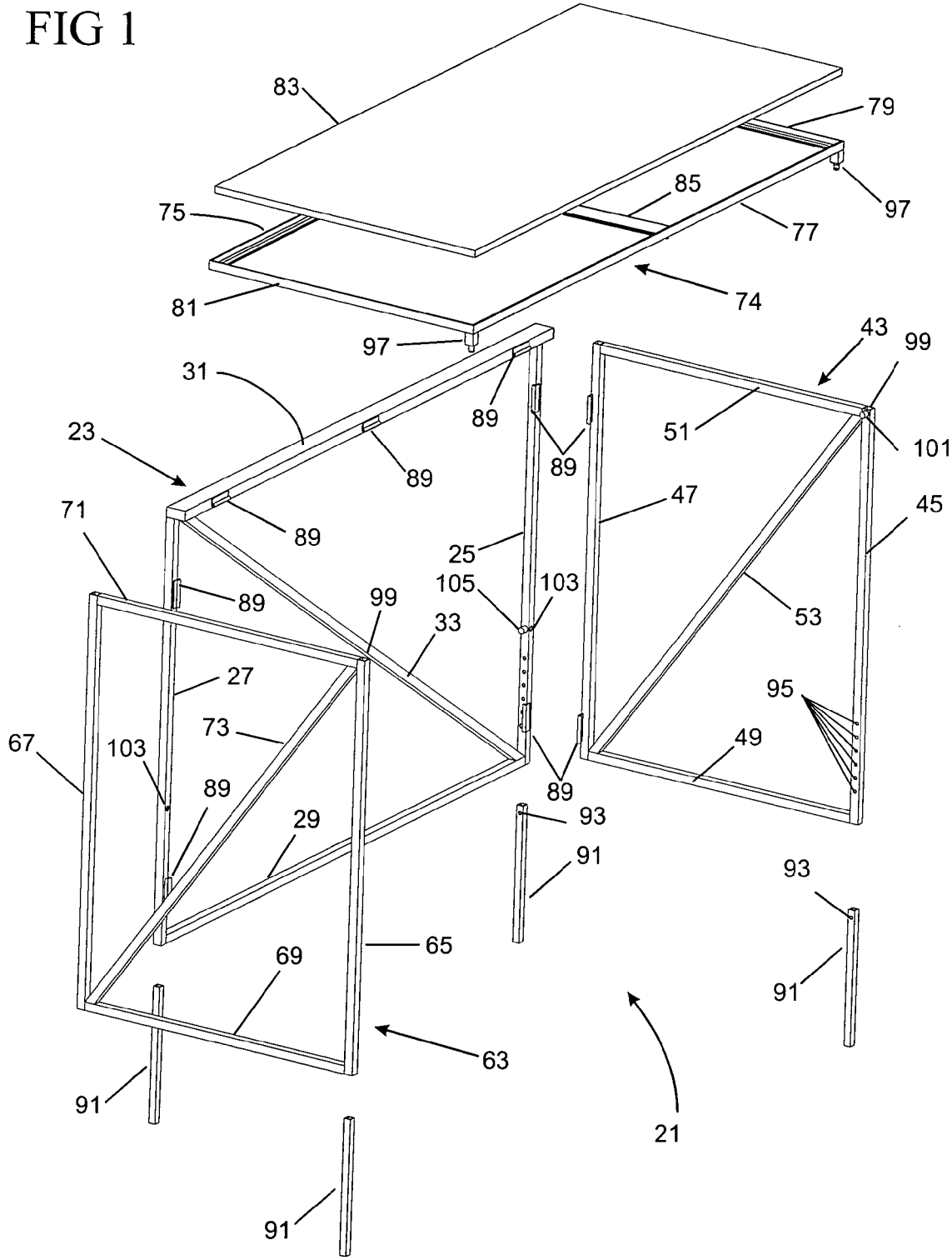
FIG. 1 is an exploded view of the support table of the invention seen from an upper rearward viewpoint.

The description and operation of the shutter system of the invention will be best described with reference to FIG. 1 which illustrates an exploded view of the table support 21 of the invention. In the lower foreground is a main support section 23 which includes a first vertical member 25, a second vertical member 27, a first horizontal member 29 and a second horizontal member 31. A diagonal member 33 is shown attached at the side of and near one end of the first horizontal member 29 and at the side of and near one end of the second horizontal member 31, preferably by welding the periphery of the end of the diagonal member 33 to its contact area at the side of first and second horizontal members 29 and 31. The attachment at the underside of second horizontal member 31 occurs flush to the side edges facing the viewer of FIG. 1. An end 35 of second horizontal member 31 is seen as overlying the first vertical member 25 to illustrate the position of attachment.

As can be seen, the second horizontal member 31 has a slightly different shape than that seen for the members 25, 27, 29 and 33. Second horizontal member 31 is preferably a rectangular tube member which preferably has interior dimension of 0.750 inches by 1.50 inches and is constructed of eighteen gauge steel. The larger size facilitates the more rearward support of a pivoting member, to be described. The remaining members 25, 27, 29 and 33 are preferably square members having an external dimension of about 0.675 inches and made of eighteen gauge steel.

To one side of main support section 23, a first side support section 43 is seen. First side support section 43 also has a first vertical member 45 second vertical member 47, first horizontal member 49, second horizontal member 51 and a diagonal member 53. The A diagonal member 33 is shown attached at the side of and near one end of the first horizontal member 29 and at the side of and near one end of the second horizontal member 31, preferably by welding the periphery of the end of the diagonal member 33 to its contact area at the side of first and second horizontal members 29 and 31. The attachment at the underside of second horizontal member 31 occurs flush to the side edges facing the viewer of FIG. 1. An end 35 of second horizontal member 31 is seen as overlying the first vertical member 25 to illustrate the position of attachment.

As can be seen, the second horizontal member 31 has a slightly different shape than that seen for the members 25, 27, 29 and 33. Second horizontal member 31 is preferably a rectangular tube member which preferably has interior dimension of 0.750 inches by 1.50 inches and is constructed of eighteen gauge steel. The larger size facilitates the more rearward support of a pivoting member, to be described. The remaining members 25, 27, 29 and 33 are preferably square members having an external dimension of about 0.675 inches and made of eighteen gauge steel.

To one side of main support section 23, a first side support 41 is seen. First side support section 43 also has a first vertical member 45 second vertical member 47, first horizontal member 49, second horizontal member 51 and a diagonal member 53. Diagonal member 53 is again shown attached at the side of and near one end of the first horizontal member 49 and at the side of and near one end of the second horizontal member 51.

To the other side of main support section 23, a second side support section 63 is seen. Second side support section 63 also has a first vertical member 65 second vertical member 67, first horizontal member 69, second horizontal member 71 and a diagonal member 73. Diagonal member 73 is again shown attached at the side of and near one end of the first horizontal member 69 and at the side of and near one end of the second horizontal member 71. Because all of the members 45, 47, 49, 51, 53, 65, 67, 69, and 71 are preferably the same shape and size they naturally fit in a flush manner with respect to each other. Also, members 45, 47, 49, 51, 53, 65, 67, 69, and 71 are preferably have external square dimension of about 0.675 inches and made of eighteen gauge steel.

Shown over the main support section 23, an upper frame section 74 is seen. Upper frame section 74 also has a first upper frame member 75 closest to the main support section 23 and a second upper frame member 77 which lies spaced apart from first upper frame member 75. A third upper frame member 79 connects one set of ends of upper frame members 75 and 77 while a fourth upper frame member 81 connects the other set of ends of upper frame members 75 and 77.

The upper frame members 75, 77, 79 and 81 are preferably made from "L" or angled steel having a thickness of about 0.125 inches and main dimensions of 0.625 inches to match the outer dimension of the members 25, 27, 29, 25, 27, 33, 45, 47, 49, 51, 53, 65, 67, 69, and 71. The inwardly directed lip of the upper frame members 75, 77, 79 and 81 will provide a resting area for a top 83 shown above the upper frame section 74. Top 83 may be made to be fixably or not fixably connected to the upper frame members 75, 77, 79 and 81. Top 83 may be made of half inch steel to lend sufficient support to up to several hundred pounds of supported structures placed atop the table support 21.

Upper frame section 74 may also preferably have one or more cross support braces 85, one of which is shown in FIG. 1. A cross support brace 85 helps to strengthen and stabilize the parallel orientation of the upper frame members 75 and 77. Preferably the cross support brace 85 will be attached in a way which does not appreciably interrupt the inwardly directed support edge of the upper frame members 75, 77, 79 and 81, so as to not upset the balance and fit of the top 83.

Also seen are a series of hinge members 89. Four of the hinge members 89 are seen in a position to join the first side support section 43 to the main support section 23, while four of the hinge members 89 are seen in a position to join the second side support section 63 to the main support section 23

Note that the members 25, 27, 29, 25, 27, 33, 45, 47, 49, 51, 53, 65, 67, 69, and 71 are attached so that the vertical members 25, 27, 45, 47, 65, and 67 have open ends at their top and bottom ends. A first embodiment is seen as a series of four leg extensions 91 are shown underneath the vertical members 45, 25, 27, and 65. The four leg extensions 91 should have the ability to assume specific positions with respect to the vertical members 45, 25, 27, and 65 to enable at least rough leveling.

The leg extension 91 have an internal spring which operates a detent button 93 which is seen on two of the leg extensions 91, and which engaged one of a series of vertically aligned apertures 95 in the vertical members 65, 27, 25 and 45. By simple thumb pressure on the detent button 93, the leg extensions 91 can be adjusted for height of the table support 21. Other supports may be employed which enable the degree of leveling to range from a continuous level of selectability to a quantified level of selectability. Apertures 95 may have center to center spacings of about one inch in order to provide even inch adjustability, and may have diameters of about 0.329 inches. The leg extension 91 has a square axial profile and an external dimension of 0.500 inches and is sized to fit within the first and second vertical members 25 and 27 of main support section 23, the first vertical member 45 of first side support section 43, and the first vertical member 65 of the second side support section 63. Quantified selectability is typically preferred for ease and structural security.

Also seen in FIG. 1 are a pair of engagement structures 97 which are seen to be attached just underneath the corners of the upper frame section 74. Engagement structures 97 are used to interfit with the openings 99 of the upper end of the first vertical member 45 of the first side support 43 and the upper end of the first vertical member 65 of the second side support 43 when the table support 21 is in the deployed position. A small, manually operated upper pull latch 101 is seen immediately adjacent the opening 99 of the first vertical member 45 of the first side support 43.

One such manually operated upper pull latch 101 which may be preferably employed can be pulled and turned to lock it to the open position. This enables users to unlock one side and then another sequentially, to enable one person operation where two such manually operated upper pull latches 101 are in use. Pulling the upper pull latch 101 outward will free the engagement structures 97 so that the upper frame section can be upwardly pivoted about the hinge members 89.

A second set of openings 103 are seen on first vertical member 25 and second vertical member 27. Only on first vertical member 25 can a lower pull latch 105 be seen, the lower pull latch 105 on the second vertical member 27 being hidden from view. As will be seen, the second openings 103 and lower pull latches 105 are used to secure the engagement structures 95 when the table support 21 is in a stowed position.

In the stowed position, after first and second side support sections 43 and 63 are folded inward, the engagement structures 97 are used to engage openings in the first vertical member 45 of the first side support section 43 and the first vertical member 65 of the second side support section 63.

As will be seen, the engagement structures 97 have a block base and an extension portion, and the downward extend of the optional reinforcing member 97 only extends as far as the block base of the engagement structures.

Note also that the hinge members 89 are seen as side-by-side hinge members rather than interfitting finger type hinges and thus the adjacency of the hinge members 89 is selected to maximize the expected force support capability. Since upper frame section 74 will bear the brunt of the support force, the placement of its hinge members 89 atop the hinge members 89 of the first and second side support sections 43 and 63 enables the upper frame section 74 to receive more support from the first and second side support sections 43 and 63.

Figure 2:
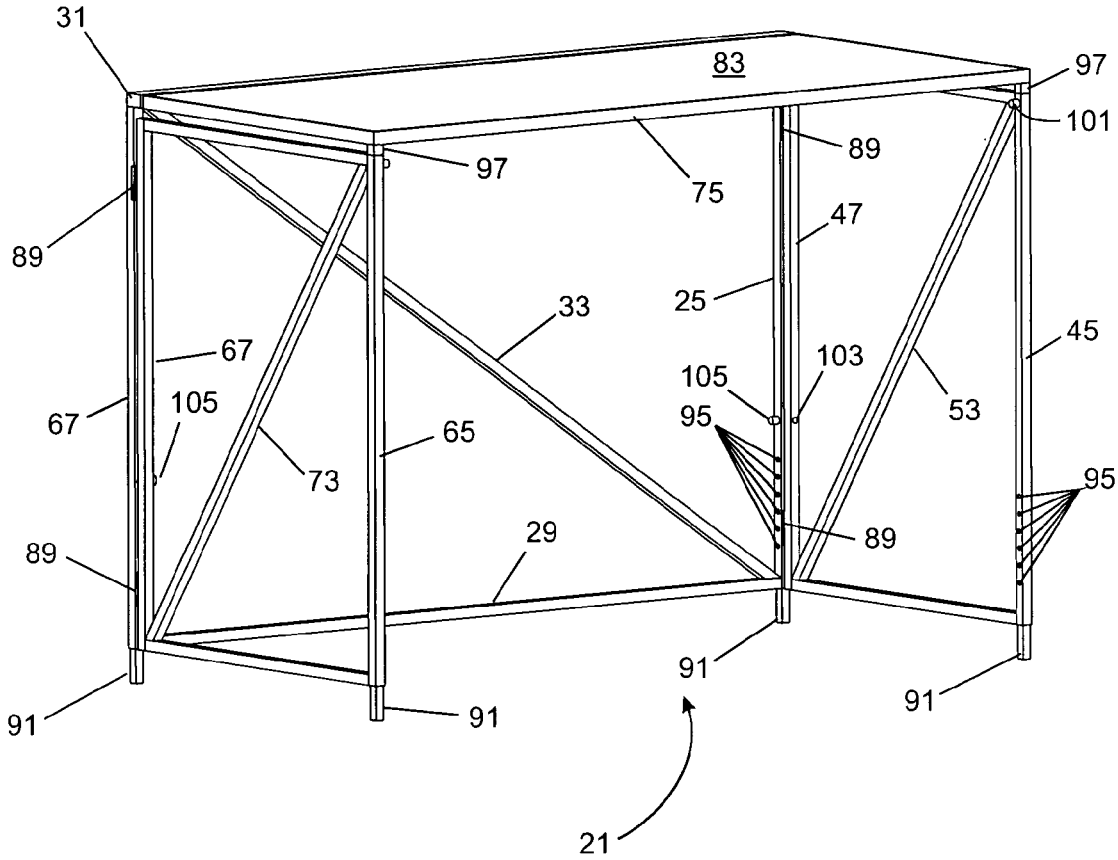
FIG. 2 is an assembled view of the support table seen in FIG. 1 from a slightly lower perspective than seen in FIG. 1.

Referring to FIG. 2, a view of the assembled table support 21 is shown. The compact relationship between the components is seen, and the operation of the leg extensions 91 is seen.

Figure 3:
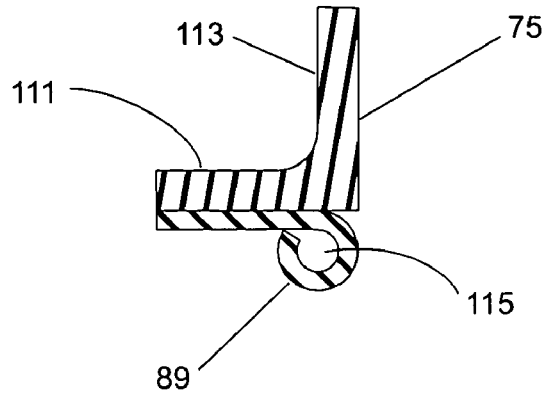
FIG. 3 is a sectional view taken through the first upper frame section and showing attachment of a hinge member.

Referring to FIG. 3, a sectional view taken along line 3—3 of FIG. 2 illustrates a sectional view of first upper frame member 75 and its attached hinge member 89. The hinge members 89 shown are simple single scroll structures, although more complex hinges could be utilized. The hinge members 89 also have a significant area in contact with the underside of the first upper frame member 75. First upper frame member 75 "L" shape is shown as having an upwardly directed shelf 111 and an inwardly directed wall 113. Hinge members 89 has a bore 115 for engaging a pin (not shown) for enabling hinge members 89 for pivoting with respect to each other.

Figure 4:
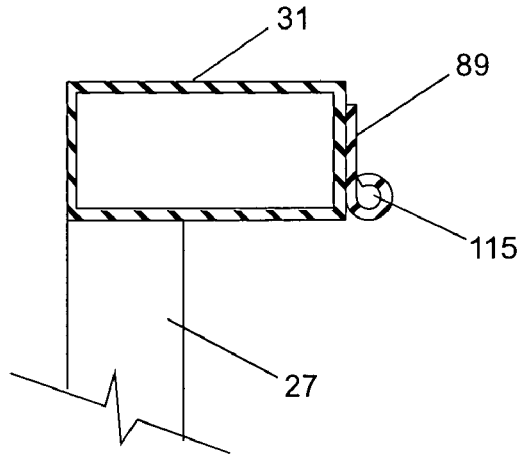
FIG. 4 is a side view of the second vertical member and looking through the second horizontal member and illustrating the orientation of attachment of a hinge member to the second horizontal member.

Referring to FIG. 4, a section taken along line 4—4 of FIG. 2 illustrates the relationship of the second horizontal member 31 with respect to the second vertical member 27 of the main support section 23. The orientation of FIG. 4 matches the orientation of FIG. 3, and is shown separately to make clearer the relationship of the hinge members 89.

Figure 5:
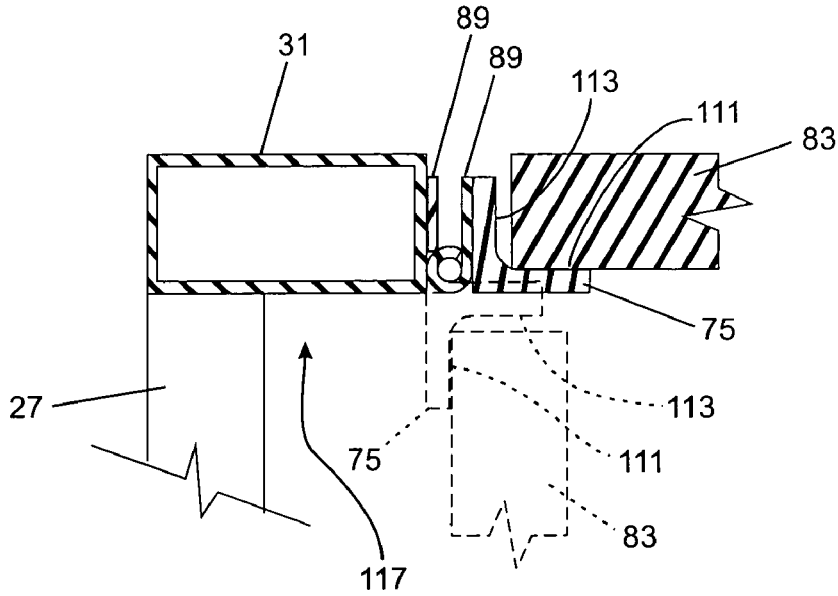
FIG. 5 combines the views of FIGS. 3 and 4 to illustrate the pivoting action of the upper frame member with respect to the second vertical member so as to create a space for accommodating the first and second side support sections.

Referring to FIG. 5, a closeup view shows the pivoting interaction between the first upper frame member 75 of upper frame section 74, and the second horizontal member 31 of the main support section 23 is shown. In the upper, deployed position, the shelf 111 is upwardly directed and forms a support for either gravity capture of the top 83 or a space for the attachment of the top 83. Attachment may be accomplished by welding, riveting or the like. The lower, stowed position is shown by the dashed line illustration. In the lower or stowed position, a space 117 is formed between the frame section 74 and the main support section 23 which is sized to easily accommodate the first and second side support sections 43 and 63 which are folded inward first, before the frame section 74 is lowered. This configuration enables the stowed assembly to be carried with the main support section 23 upright and in a position for the frame section 74 to effectively trap the first and second side support sections 43 and 63 which will not inadvertently fall open. In addition, the engagement structures 97 attached to the frame section 74 will engage the second vertical members 47 and 67 of the first and second side support sections 43 and 63, respectively, as will be shown.

Figure 6:
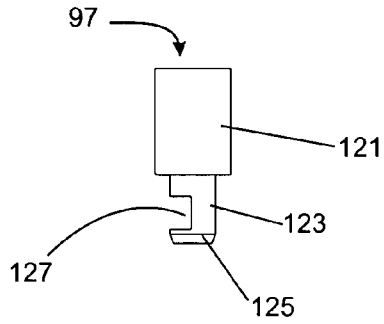
FIG. 6 is a plan view of an engagement structure to be attached to the upper frame member.

Referring to FIG. 6, an expanded version of the engagement structure 97 is shown as having a block base 121 and an extension portion 123. The block base 121 is about 0.625 inches wide to match the other structural members of the table support 21, and has a height of about 0.855 inches. The uppermost extent of the extension portion has a slight conical or circularly beveled surface 125 to help act as a guide for insertion into a matching aperture. The extension portion has a lateral notch 127 having a height of about 0.27 inches to be engaged by a spring loaded lock which provides an interference member to fit within the lateral notch 127 to capture the engagement structure 97. Capture is had to result in a stable, locked deployed position as well as a stable locked foldably stowed position. The height of the extension portion is about 0.583 inches, and its diameter is about 0.375 inches.

Figure 7:
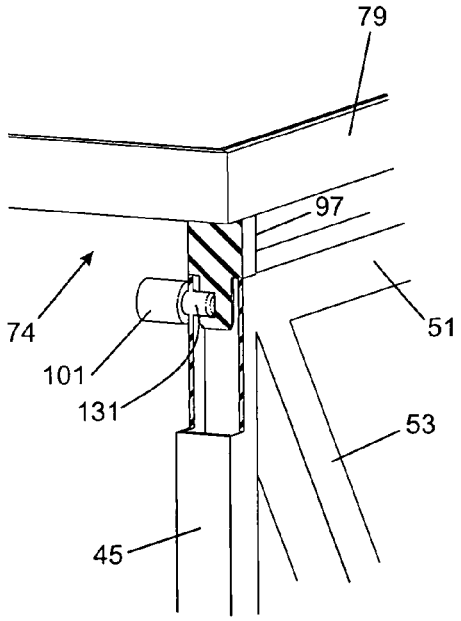
FIG. 7 is a partial sectional view illustrating the engagement structure of FIG. 6 attached to the upper frame member and into an opening in the first vertical member to lock the upper frame member into a stable configuration.

Referring to FIG. 7, a partial sectional view illustrates a partially broken away view of the upper part of first vertical member 45 and an expanded view of the upper pull latch 101 and its engagement with the lateral notch 127 of the engagement structure 97. The positioning of the right hand upper pull latch 101 is shown, and oriented toward the left hand upper pull latch 101 to enable a user to grasp the pull latches 101 and pull them toward each other to release the engagement structures 97 to release the upper frame section 74. As can be seen from the view of FIG. 7, the upper pull latch 101 has an insertion member 131 which engages the lateral notch 127 to prevent the upper frame section 74 from being lifted up and to keep the table support 21 is a stable configuration. Note that the block base 121 (previously shown in FIG. 6) provides a stand off or gap between the third upper frame member 79 and the second horizontal member 51.

Figure 8:
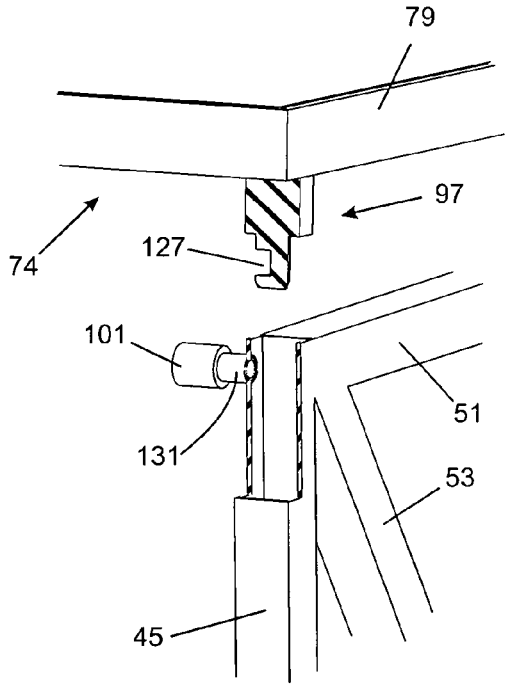
FIG. 8 is a view I accord with the view of FIG. 7 with the manually operated pull latch moved to the release position and with the upper frame member raised enough to clear the engagement structure clear of the first vertical member.

Referring to FIG. 8, a partial sectional view in accord with the view shown in FIG. 7 illustrates the upper pull latch 101 in the withdrawn position enabling the disengagement of engagement structure 97 and the upward movement of the upper frame member 74. A simplified upper pull latch 101 is shown for clarity and simplicity, and in use a pull latch 101 will be spring loaded and mount using a sleeve or other structure which keeps it engaged with the lateral notch 127 when latch 101 is at rest.

Figure 9:
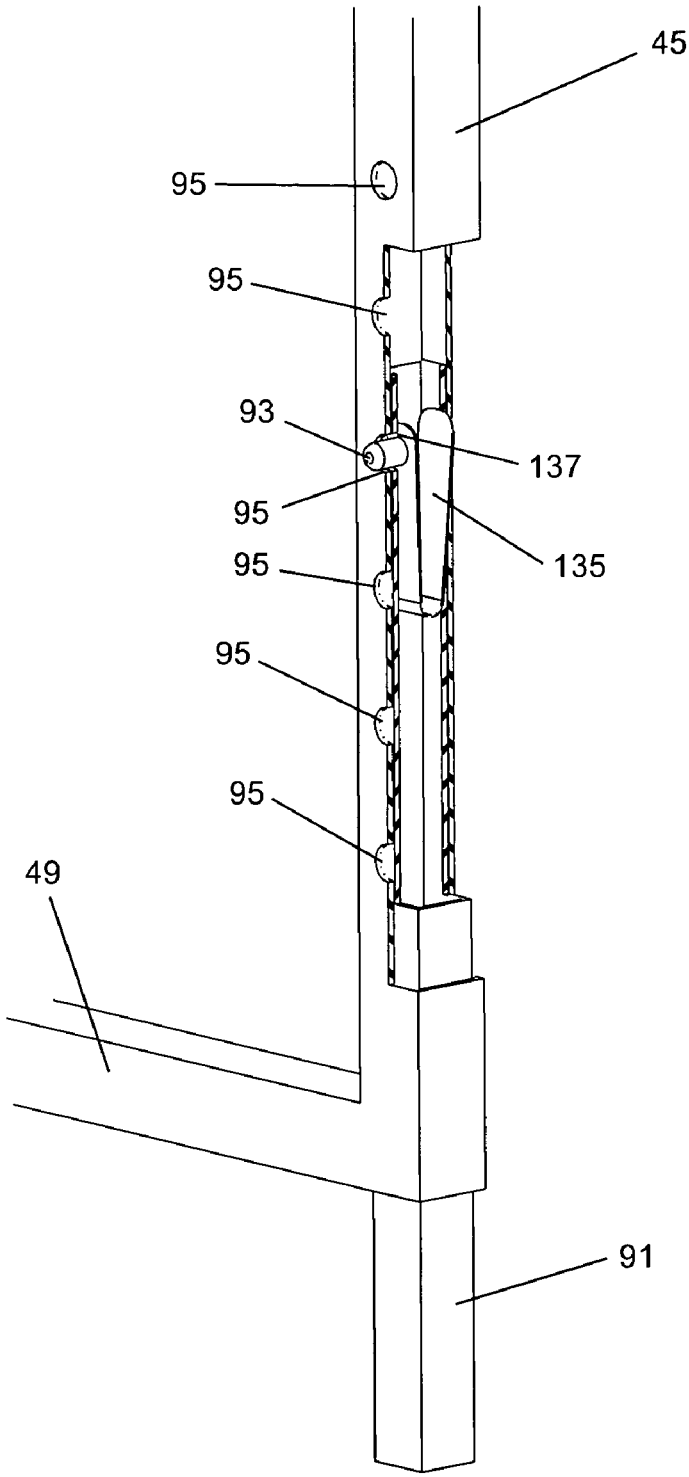
FIG. 9 is a partially broken away view of the lower portion of the first vertical member illustrating the internals of both a first vertical member and a leg extension.

Referring to FIG. 9, a perspective partially broken away view of the lower portion of the first vertical member 45 reveals the internals of both the first vertical member 45 and the leg extension 91 within it. A "U" shaped spring 135 is seen attached to the detent button 93. This configuration enables the spring 135 and detent button 93 to be inserted into the upper end of the leg extension 91 until the detent button 93 extends through a detent aperture 137 at the upper end of the leg extension. The detent button 93 is then pushed in enough to clear the lower edge of the first vertical member 45 and until it encounters one of the series of vertically aligned apertures 95 where it is urged outwardly to a locking position. Movement from one of the series of vertically aligned apertures to the next is accomplished by pressing in the detent button 93 along with up or down axial pressure on the leg extension 91. The spring 135 and axial length of the detent button 93 insures that once the leg extension 91 is locked into place that it will not move, even under heavy load.

Figure 10:
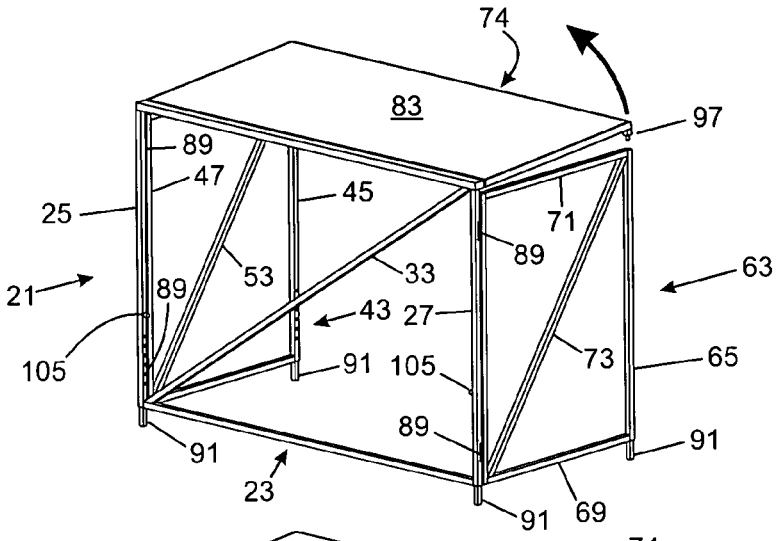
FIG. 10 illustrates a view of the table support with the upper frame section raised sufficiently to enable initiation of the folding to a compact stowed configuration.
Figure 11:
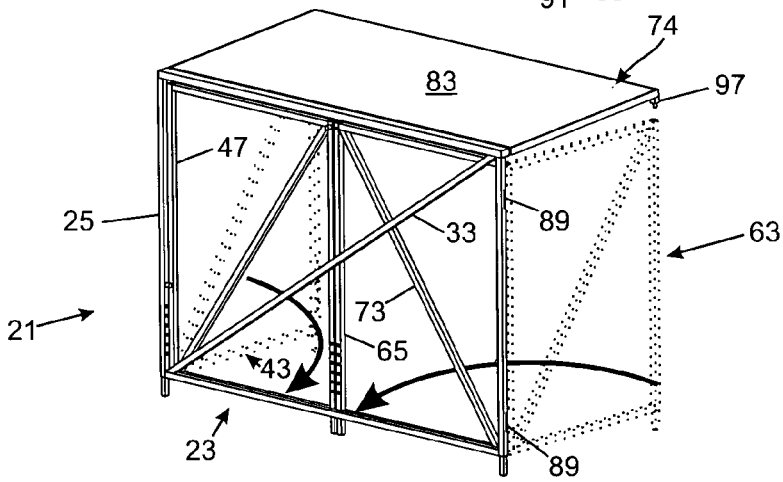
FIG. 11 illustrates a view in accord with FIG. 10 and illustrates the folding of the first and second side support sections to a position generally parallel with a rear main support section.
Figure 12:
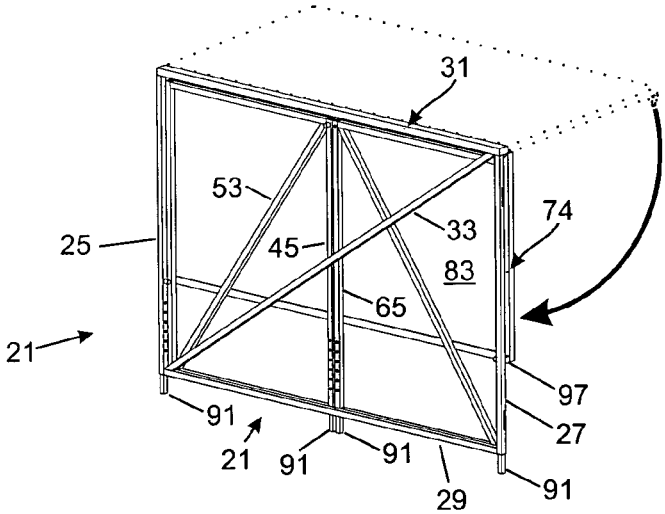
FIG. 12 illustrates a view in accord with FIGS. 10 and 11 and illustrates the folding down of the upper frame section to a position generally parallel with a rear main support section while capturing the first and second side support sections in a secured and stable position.

Referring to FIGS. 10–12, a perspective series of views illustrates the folding of the table support 21 to a compact position for transfer or storage. Once the upper pull latches 101 are pulled toward each other, the engagement structures are freed as to enable the upper frame section 74 to be raised. The views of FIG. 10–12 assume that the top 83 is attached to and stays with the upper frame section 74 on folding and storage.

Once the upper frame section 74 is raised, the first and second side support sections 43 and 63 are pivoted toward each other and then toward the main support section 23. The solid line rendering of first and second side support sections 43 and 63 are shown in a position immediately adjacent the main support section 23. The location and orientation of the hinges 89 are so as to enable such immediate flat adjacency to the main support section 23.

Likewise, the combination of the hinges 89 and the width of the second horizontal member 31 will enable the pivot axis of the upper frame section 74 to be rearward enough with respect to FIG. 11 to enable the upper frame section 74 to fold over the outside of and immediately adjacent the first and second side support sections 43 and 63 capture them against the main support section 23. In FIG. 12, the engagement structures 27 are seen as interfitting within the second set of openings 103 to lock the upper frame section 74 into main support section 23.

Figure 13:
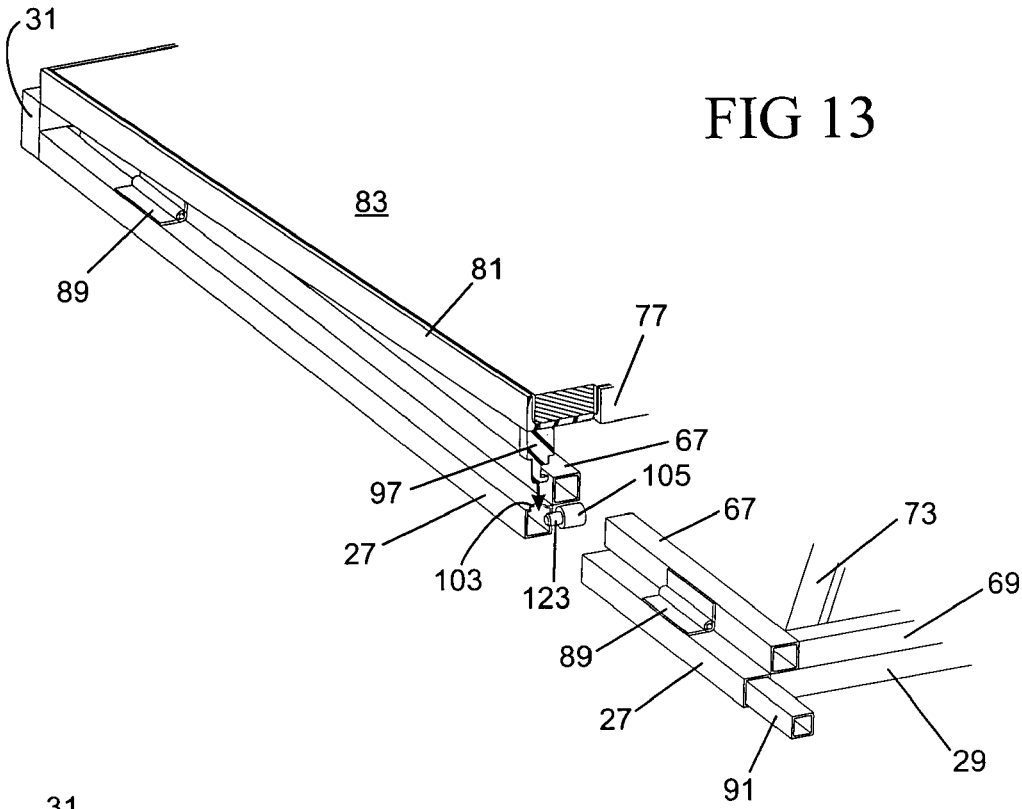
FIG. 13 illustrates a closeup view consistent with a position just before achieving the stowed locked view of FIG. 12 and shown with the lower portions of the main support section and second side support axially separated and displaced to illustrate details of the lower pull latch.

Referring to FIG. 13, a closeup view consistent with a position just before achieving the view of FIG. 12 is shown with the lower portions of the main support section 23 and second side support 63 axially separated and displaced to illustrate an open section view of the second vertical member 27 of the main support section 23 and second vertical member 67 of the second side support 63. The lower pull latch 105 is shown in the pulled open position, ready to accept the engagement structure 97 which is shown in half section. If extension portion 123 is of the correct length to enable the conical or circularly beveled surface 125 to urge the lower pull latch 105 out of the way, entering engagement of the engagement structure 97 may be somewhat automatic. The same is true for the upper pull latch 101.

In addition, a small section of second upper frame member 77 is removed to show the relationship of the top 83 within the upper frame section 74. The relationship of the hinges 89 are shown and the gap between the second vertical member 27 of the main support section 23 and the fourth upper frame member 81 is seen to accommodate the second vertical member 67 of the second side support 63.

Figure 14:
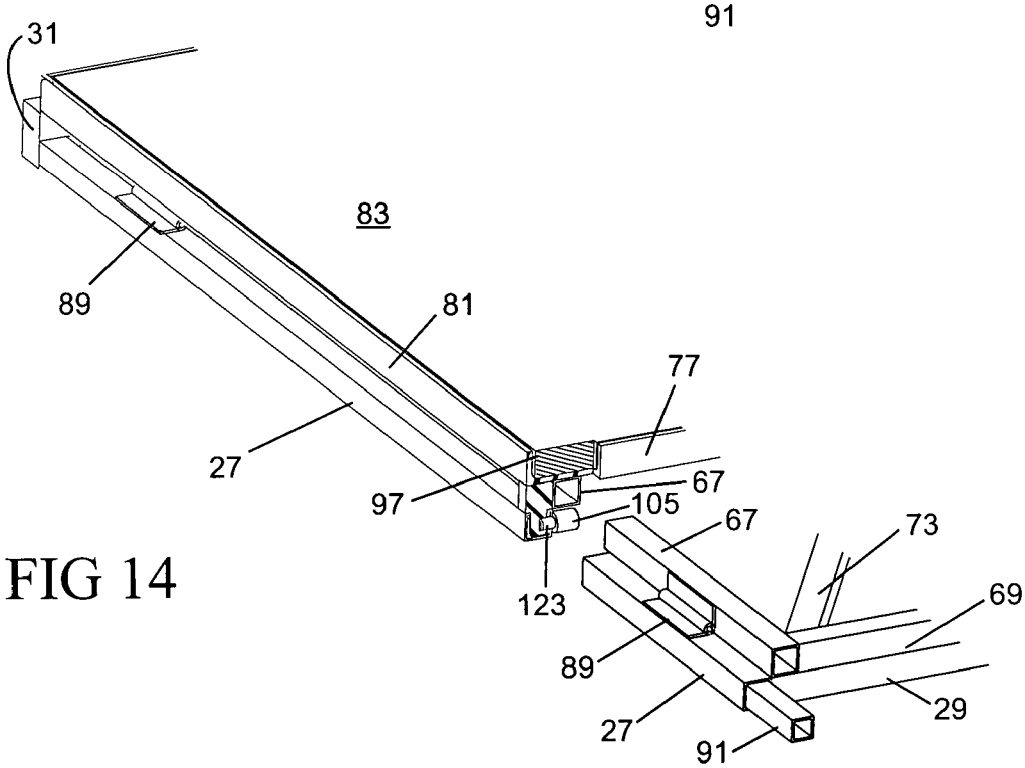
FIG. 14 illustrates the completion of the action of closure which was shown as about to be completed in FIG. 13.

FIG. 14 illustrates the completion of the action of closure which was shown as about to be completed in FIG. 13, and is consistent with the configuration shown in FIG. 12. FIG. 14 is also shown with the lower portions of the main support section 23 and second side support 63 axially separated and displaced to illustrate the same details surrounding the second pull latch 105 shown in FIG. 13.

Figure 15:
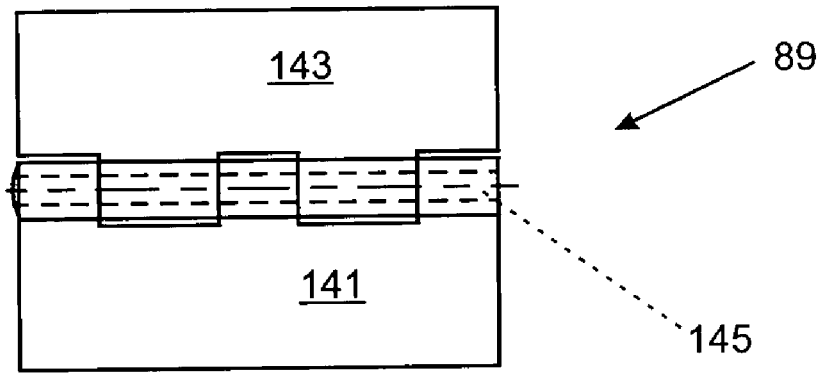
FIG. 15 is a plan view of a preferred hinge member used for securing the side support sections, main support section and upper frame section.

Referring to FIG. 15, a plan view of a preferred hinge 89 is seen as having a first plate 141 having three projections and a second plate 143 having two interfitting projections. A pin 145 is shown in dashed line format. The preferred hinge 89 has a thickness of about 0.0600, an a length in the axial direction of the pin 145 of about two inches. The distance from the pivot pin to the outer edge is preferably about 0.750 inches.

While the present invention has been described in terms of a table deployment, stowage, and support system for enabling quick set up and take down of a horizontal table support having significant weight bearing characteristics, one skilled in the art will realize that the structure and techniques of the present invention can be applied to many structures, including structures where stable deployment and stowage is an advantage.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A table comprising:

a main support section having a first main support vertical member having a first and a second end, a second main support vertical member having a first and a second end, a first main support horizontal member having a first end attached to said first end of said first main support vertical member and a second end attached to said first end of said second main support vertical member, and a second main support horizontal member having a first end attached to said second end of said first main support vertical member and a second end attached to said second end of said second main support vertical member;

a first side support section having a first side first vertical member having a first and a second end, a first side second vertical member having a first and a second end, a first side first horizontal member having a first end attached to said first end of said first side first vertical member and a second end attached to said first end of said first side second vertical member, and a first side second horizontal member having a first end attached to said second end of said first side first vertical member and a second end attached to said second end of said first side second vertical member, said first side first vertical member pivotably connected to said first main support vertical member to enable pivoting of said first side support section between a first position parallel and closely adjacent said main support section and a second position generally perpendicular to said main support section;

a second side support section having a second side first vertical member having a first and a second end, a second side second vertical member having a first and a second end, a second side first horizontal member having a first end attached to said first end of said second side first vertical member and a second end attached to said first end of said second side second vertical member, and a second side second horizontal member having a first end attached to said second end of said second side first vertical member and a second end attached to said second end of said second side second vertical member, said second side first vertical member pivotably connected to said second main support vertical member to enable pivoting of said second side support section between a first position parallel and closely adjacent said main support section and a second position generally perpendicular to said main support section;

an upper support member pivotably attached to said second main support horizontal member to enable pivoting of said upper support member between a first position supported by said main support and said first and said second side supports, and a second position adjacent and generally parallel said first and second side supports, supported by said main support.

2. The table as recited in claim 1 and further comprising an engagement structure carried by said upper support member for locking said upper support member to one of said first and said second side support sections in said first position, and for locking said upper support member to said main support in said second position.

3. The table as recited in claim 2 wherein said engagement structure further comprises:

a base portion attached to said upper support member;

an extension portion attached to said base portion and having a lateral notch for facilitating engagement locking.

4. The table as recited in claim 1 wherein said an upper support member and said main support create a space within which at least half of said first and said second side supports fit when said upper support member is placed in said second position adjacent and generally parallel said first and second side supports, and said main support.

5. The adjustable table as recited in claim 1 wherein said first and second main support vertical members and said first and second side first vertical members all have open first ends and further comprising leg extensions fittable in said open ends, said leg extensions are fixable within said first ends of said first and second main support vertical members and said first and second side first vertical members.

* * * * *